US009155364B2

(12) United States Patent
Jason

(10) Patent No.: US 9,155,364 B2
(45) Date of Patent: Oct. 13, 2015

(54) SUNSHADE POSITIONING DEVICE

(71) Applicant: Mario Jason, Sherman Oaks, CA (US)

(72) Inventor: Mario Jason, Sherman Oaks, CA (US)

( * ) Notice: Subject to any disclaimer, the term of this patent is extended or adjusted under 35 U.S.C. 154(b) by 0 days.

(21) Appl. No.: 14/246,837

(22) Filed: Apr. 7, 2014

(65) Prior Publication Data

US 2015/0114438 A1 Apr. 30, 2015

Related U.S. Application Data

(60) Provisional application No. 61/895,030, filed on Oct. 24, 2013.

(51) Int. Cl.
*A45B 17/00* (2006.01)

(52) U.S. Cl.
CPC ..... *A45B 17/00* (2013.01); *A45B 2017/005* (2013.01)

(58) Field of Classification Search
CPC ..... A45B 11/00; A45B 17/00
USPC ..... 135/16, 20.1; 248/515, 538
See application file for complete search history.

(56) References Cited

U.S. PATENT DOCUMENTS

| | | | | |
|---|---|---|---|---|
| 1,020,846 | A | | 3/1912 | Rauch |
| 2,475,406 | A | | 7/1949 | Russell |
| 2,724,396 | A | | 11/1955 | Pereira |
| 2,863,468 | A | | 12/1958 | Small |
| 2,979,065 | A | | 4/1961 | Small |
| 3,142,307 | A | | 7/1964 | Danciart et al. |
| 3,175,568 | A | * | 3/1965 | Kafka ..... 135/20.3 |
| 3,850,186 | A | * | 11/1974 | Weber et al. ..... 135/20.3 |
| 4,347,834 | A | | 9/1982 | York |
| 4,582,078 | A | | 4/1986 | Ma |
| 4,674,522 | A | | 6/1987 | Ma |
| 4,697,606 | A | | 10/1987 | Ma |
| 4,878,509 | A | | 11/1989 | Tung |
| 5,029,596 | A | | 7/1991 | Tung |
| 5,086,797 | A | | 2/1992 | Earnshaw et al. |
| 5,360,163 | A | | 11/1994 | Dupre |
| 5,590,673 | A | | 1/1997 | Earnshaw |
| 5,749,386 | A | * | 5/1998 | Samuel, Jr. ..... 135/16 |

(Continued)

FOREIGN PATENT DOCUMENTS

| | | |
|---|---|---|
| DE | 4118402 | 1/1993 |
| DE | 19535523 | 3/1997 |

(Continued)

*Primary Examiner* — Noah Chandler Hawk
(74) *Attorney, Agent, or Firm* — Jafari Law Group, Inc.; David V. Jafari; Saul Acherman

(57) ABSTRACT

The invention generally relates to an apparatus for controlling tilt and pivot movement of an umbrella, or a sunshade positioning device. In one embodiment, an umbrella support receiving member and a positioning and tilt control unit can be used to retrofit any umbrella to enable the umbrella for quick and easy positioning for maximizing a shaded area throughout the day. The positioning unit can be coupled to an umbrella's support member, or post, towards the bottom of the support member. A receiving member connects the positioning unit to the umbrella support member, and control of the positioning unit causes the support member to move back and forth, thereby changing the angle at which the umbrella is positioned with relation to a surface. The positioning unit can be controlled by hand, or by a small electric motor that actuates the connector coupled to the umbrella support member.

13 Claims, 9 Drawing Sheets

(56) References Cited

U.S. PATENT DOCUMENTS

| | | | | |
|---|---|---|---|---|
| 5,836,327 | A | 11/1998 | Davis | |
| 6,170,497 | B1 | 1/2001 | Ma | |
| 6,230,724 | B1 | 5/2001 | Lai | |
| 6,311,705 | B1 | 11/2001 | Ma | |
| 6,446,650 | B1 | 9/2002 | Ma | |
| 6,516,820 | B1 | 2/2003 | Earnshaw | |
| 6,810,892 | B2 | 11/2004 | Lai | |
| 7,028,699 | B2 | 4/2006 | Lee | |
| 7,040,593 | B1 * | 5/2006 | Weatherall | 248/514 |
| 7,172,168 | B1 | 2/2007 | Kallas | |
| 7,207,343 | B2 | 4/2007 | Earnshaw et al. | |
| 7,255,118 | B2 | 8/2007 | Vardy et al. | |
| 7,334,593 | B2 | 2/2008 | Avery | |
| 7,363,930 | B2 | 4/2008 | Vanderminden, Sr. | |
| 7,493,909 | B2 | 2/2009 | Ma | |
| 7,533,680 | B2 | 5/2009 | Ma | |
| 7,631,653 | B2 * | 12/2009 | Young et al. | 135/15.1 |
| 7,708,022 | B2 | 5/2010 | Joen-an Ma | |
| 7,717,121 | B2 | 5/2010 | Glatz | |
| 7,926,496 | B2 | 4/2011 | Young et al. | |
| 7,926,497 | B2 | 4/2011 | Young et al. | |
| 8,291,923 | B2 | 10/2012 | Young et al. | |
| 8,607,714 | B2 * | 12/2013 | Ramberg | 108/50.12 |
| 2004/0134526 | A1 * | 7/2004 | Freedman | 135/20.3 |
| 2006/0054772 | A1 * | 3/2006 | Priscott et al. | 248/558 |
| 2009/0314319 | A1 | 12/2009 | Young et al. | |
| 2010/0258150 | A1 | 10/2010 | Young et al. | |
| 2011/0192434 | A1 | 8/2011 | Young et al. | |

FOREIGN PATENT DOCUMENTS

| | | |
|---|---|---|
| DE | 202004009992 | 9/2004 |
| EP | 0681794 | 11/1995 |
| EP | 1040771 | 10/2000 |
| EP | 1069844 | 1/2001 |
| EP | 1076493 | 2/2001 |
| EP | 1392140 | 3/2004 |
| EP | 1484995 | 5/2006 |
| EP | 1568293 | 3/2008 |
| EP | 1700536 | 2/2009 |
| WO | WO9952394 | 10/1999 |
| WO | WO9956579 | 11/1999 |
| WO | WO02094053 | 11/2002 |
| WO | WO2006109103 | 10/2006 |

* cited by examiner

SUNSHADE POSITIONING DEVICE

PRIORITY NOTICE

The present application claims priority under 35 U.S.C. §119(e) to U.S. Provisional Patent Application Ser. No. 61/895,030 filed on Oct. 24, 2013, the disclosure of which is incorporated herein by reference in its entirety.

TECHNICAL FIELD OF THE INVENTION

The present invention relates in general to a sunshade positioning device, and more specifically, to an apparatus that may be coupled to an umbrella or sunshade, in order to control its tilt and pivot movement the device capable of retrofitting any sunshade with the capability to provide shade during the entire day by allowing angle and directional repositioning.

BACKGROUND OF THE INVENTION

It is known that umbrellas, or sunshades, have been used to provide shade from the sun. Commonly used in backyards, at a beach, in a park, or at any other outdoor location, sunshades are typically set up near a table or a sitting area to provide people with shade.

Some sunshades come modified so that they may be placed on a table, or for example, through an opening in the center of a table so that the sunshade provides shade for individuals sitting at that table. However, as a day progresses, the angle at which the sun's rays hit the sunshade change, and thus the area that is shaded changes as well. An individual enjoying the shade must then move, or move the entire table in order to continue enjoying the shade. Typically, this proves too burdensome, as the table is heavy, or attached to a surface so that changing its location is impossible or impractical.

Other sunshades come attached to tables, or to heavy bases made of cement, or are somehow permanently affixed to the ground. These present the same problem because an individual typically has to change locations throughout the day as the angle at which the sun's rays hit the sunshade constantly changes. Thus, the user will have to constantly move locations in order to be positioned so that they can continue to enjoy the shade, and thus, in many instances the sunshade becomes useless as a source of shade from the sun.

One solution is always to simply reposition the sunshade no matter how large and heavy it is. By placing the sunshade either at a different angle, or in a different location, the user will be able to create the desired shade depending on the hour of the day. However, as stated above, this is undesirable because a user enjoying a day by, for example, the pool, will have to do so continuously throughout the day, which means constantly moving the sunshade from one location to another. Furthermore, depending on the user, for example kids, this may prove an impossible task when dealing with very heavy sunshades or sunshades affixed to the ground.

The prior art tries to address this problem by providing some umbrellas or sunshades with a tilting mechanism about halfway or towards a top portion of the umbrella or sunshade. This, however, does not address the issue of maximizing shade. For example, such devices only provide limited cover because the tilted portion of the umbrella begins too high up and thus too far from the user, lessening the shaded area coverage of the umbrella or sunshade. This leads to light that penetrates and often hits a user in an undesired manner. Hence, these devices do not properly maximize the shaded area potential that an umbrella can provide.

Accordingly, it would be desirable to provide a sunshade that is easily adjustable, and could be controlled to provide maximal shade throughout the day without forcing a user to relocate from their current position, physically move the entire sunshade, or worry whether the sunshade is or is not permanently affixed to a surface.

Therefore, in light of the problems presented by the prior art, there is a need in the art for a device or apparatus for controlling tilt and pivot movement of an umbrella in order to provide shade throughout the day. It is to these ends that the present invention has been developed.

BRIEF SUMMARY OF THE INVENTION

To minimize the limitations in the prior art, and to minimize other limitations that will be apparent upon reading and understanding the present specification, the present invention describes an apparatus for controlling tilt and pivot movement of an umbrella, and more specifically, to an apparatus that may be coupled to an umbrella, such as a sun-shade umbrella, in order to control its tilt and pivot movement thereby retrofitting any umbrella with the capability to provide shade during the entire day.

A device for positioning an umbrella, in accordance with one embodiment of the present invention, comprises: a shaft receiving member; an actuator, coupled to said shaft receiving member, for enabling control of a tilt angle of the umbrella; and a base, coupled to the actuator, for supporting the device and the umbrella and permitting rotation of the device.

A device for positioning an umbrella, in accordance with another embodiment of the present invention, comprises: a shaft receiving member; an actuator, coupled to said shaft receiving member, for enabling control of a tilt angle of the umbrella; a base, coupled to the actuator, for supporting the device and the umbrella and permitting device rotation; a supporting body atop the base to support the shaft receiving member; an extending member, coupled to the actuator, which extends or retracts to influence the tilt angle of the umbrella; and a shaft coupling member, configured to support the umbrella's shaft.

A system for maximizing umbrella shade, in accordance with yet another embodiment of the present invention, comprises: an umbrella, the umbrella comprising: a shaft, a canopy coupled to the shaft, and an assembly for supporting the canopy; and a device for positioning the umbrella, the device comprising: a shaft receiving member, an actuator, coupled to said shaft receiving member, for enabling control of a tilt angle of the umbrella, and a base, coupled to the actuator, for supporting the device and the umbrella and permitting rotation of the device, and a supporting body atop the base for supporting the shaft receiving member.

It is an objective of the present invention to provide a means of allowing a user to retrofit any outdoor umbrella with a mechanism that aids in the control or positioning and tilting of the umbrella so as to provide shade.

It is another objective of the present invention to provide users with a means to easily control the position and angle at which their umbrellas or sunshades hit the sun's rays in order to maximize a shaded area throughout the day.

It is yet another objective of the present invention to provide users with a retrofitted sunshade that may be installed in their backyard.

It is yet another objective of the present invention to provide users with a means to easily and safely reposition an angle at which the umbrella or sunshade hits the sun's rays throughout the day, without having to lift or set up the umbrella multiple times.

It is yet another objective of the present invention to provide a control mechanism so that a user may easily change a sunshade's positioning or angle, without having to physically reposition the sunshade.

These and other advantages and features of the present invention are not meant as limiting objectives, and are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. The drawings that accompany the detailed description can be briefly described as follows:

FIG. 1(*b*) shows an outdoor umbrella, or sun-shade, retrofitted with a positioning device in accordance with the embodiment of the present invention shown in FIG. 1(*a*), wherein the sunshade positioning device has been activated to reposition the sunshade in order to maximize a shaded area without having to physically move or install the sunshade in a different location.

FIG. 1(*c*) shows an outdoor umbrella, or sun-shade, retrofitted with a positioning device in accordance with the embodiment of the present invention shown in FIG. 1(*a*) and FIG. 1(*b*), illustrating how the sunshade positioning device can be configured to reposition the sunshade by rotating the sunshade about its vertical axis and by tilting or swinging the sunshade about its horizontal axis.

FIG. 3(*b*) is an exploded view of the actuator that makes up the sunshade device shown in FIG. 2, in accordance with an exemplary embodiment of the present invention.

DETAILED DESCRIPTION OF THE INVENTION

In the following discussion that addresses a number of embodiments and applications of the present invention, reference is made to the accompanying figures that forms a part thereof, where depictions are made, by way of illustration, of specific embodiments in which the invention may be practiced. It is to be understood that other embodiments may be utilized and changes may be made without departing from the scope of the present invention.

Generally, the invention involves an apparatus for controlling tilt and pivot movement of an umbrella. In one embodiment, the apparatus may be a sunshade positioning device that comprises an umbrella support receiving member and a positioning and tilt control actuator. The apparatus or device may be used to retrofit any umbrella to enable the umbrella for quick and easy positioning. This maneuverability allows for maximizing a shaded area throughout the day. The positioning device may be coupled to an umbrella's support member, or post, towards the bottom of the umbrella's or sunshade's support member. A receiving member of the device connects the device to the umbrella. Actuating the device, by activating an actuator, enables control over forwards and backwards motion, and thereby changes the angle at which the umbrella is positioned with relation to a surface. The positioning unit can be controlled by hand, or by a small electric motor that actuates the connector coupled to the umbrella support member.

Figure 1A:
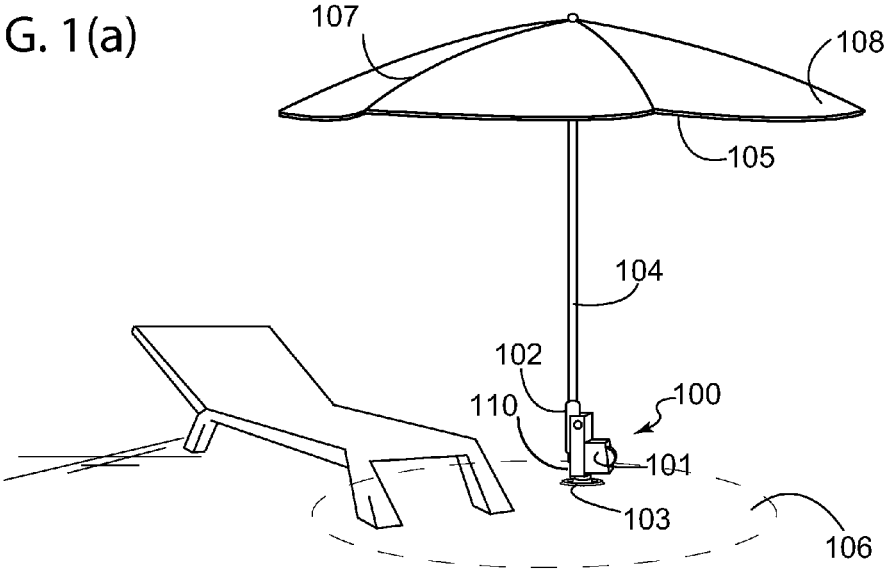
FIG. 1(*a*) shows an outdoor umbrella, or sun-shade, retrofitted with a positioning device in accordance with one embodiment of the present invention.
Figure 1B:
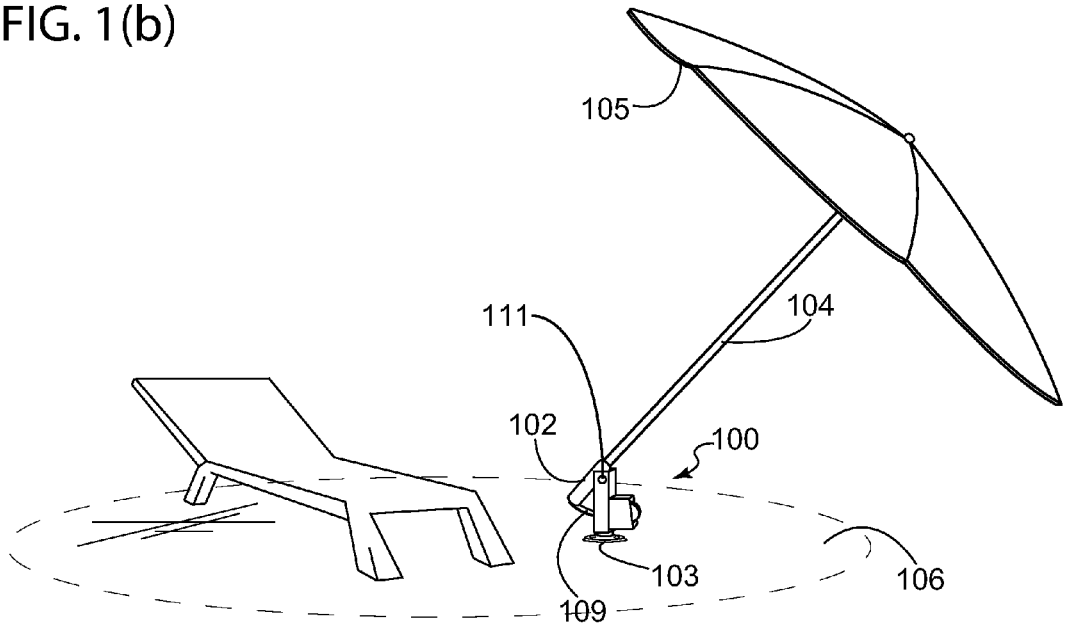
Figure 1C:
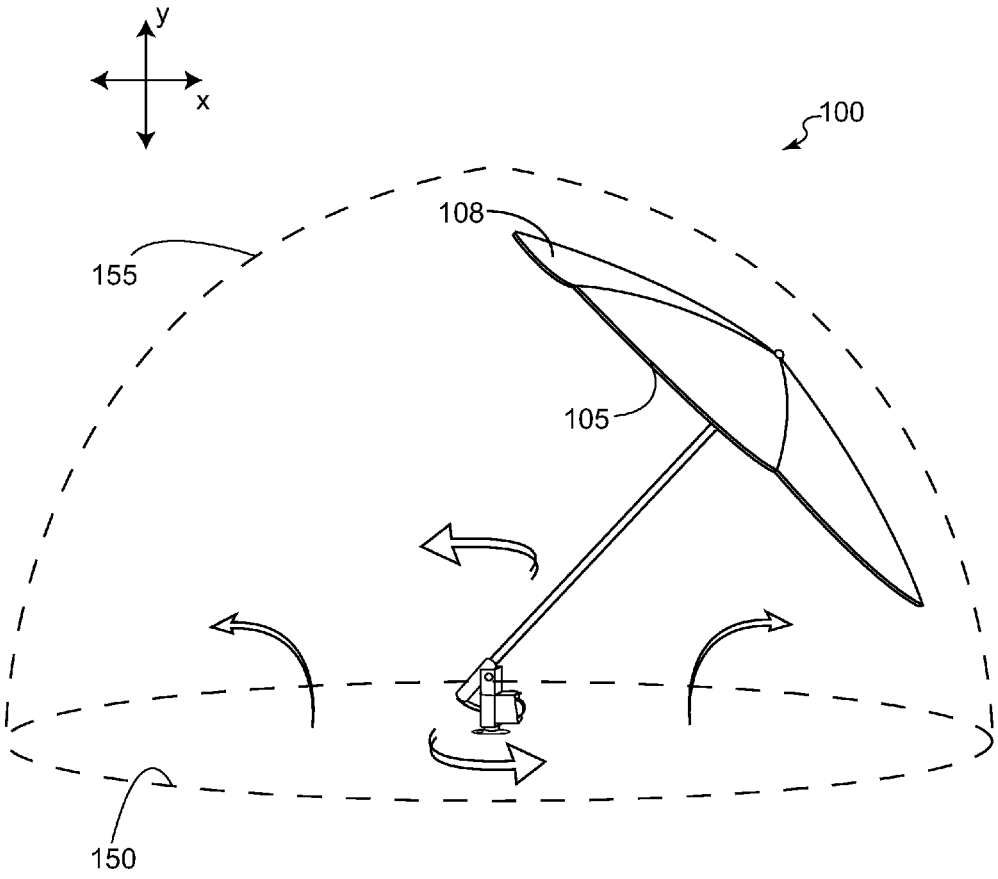

FIG. 1(*a*) shows an outdoor umbrella, or sun-shade, retrofitted with a positioning device in accordance with one embodiment of the present invention. More specifically, FIG. 1(*a*) shows sunshade 105, which has been retrofitted with sunshade positioning device 100. Sunshade positioning device 100 comprises actuator 101, sunshade receiving member 102, and base 103.

Typically, sunshade positioning device 100 can be constructed of any durable material such as a metal or durable plastic. Hence, sunshade positioning device 100 can be constructed using iron, steel, aluminum, or any other metal or metal alloy, or plastics or polymers without deviating from the scope of the present invention. In an exemplary embodiment, a combination of plastics and metals are used to construct sunshade positioning device 100 so that it can be easily manufactured in parts, thereby facilitating its shipment, distribution, and assembly. Each of the components or parts that make up device 100 will be discussed in more detail below.

Sunshade positioning device 100 comprises at least one actuator, such as actuator 101. Actuator 101 is mechanically coupled to sunshade 105 in a manner so that actuation of sunshade positioning device 100 controls a tilt angle of sunshade 105 and/or a rotation of sunshade 105, with relation to a surface. Actuator 101 can be any type of actuator, which can be mechanically coupled to shaft 104 of sunshade 105, including but not limited to a hydraulic actuator, a pneumatic actuator, an electric actuator, a mechanical actuator, or any other similar device for actuating motion and providing the energy, force, torque, or mechanical motion to position and/or rotate sunshade 105.

For example, and without limiting or deviating from the scope of the present invention, in one embodiment, actuator 101 can be a hydraulic actuator, comprising a cylinder or fluid motor that uses hydraulic power to facilitate mechanical operation of sunshade positioning device 100. In such embodiment, actuator 101 would provide a mechanical motion that would produce an output in terms of linear, rotary, or oscillatory motion. Hence, actuator 101 could be coupled to receiving member 102 and transfer motion in order to position and reposition sunshade 105 to capture a desired amount of shade during any time of the day.

In another embodiment, actuator 101 comprises a pneumatic actuator, which converts energy formed by compressed air at high pressure into either linear or rotary motion. In yet another embodiment, actuator 101 comprises an electric actuator, which is powered by a small motor that converts electrical energy to a mechanical torque.

In an exemplary embodiment, actuator 101 comprises a mechanical actuator, which functions by converting rotary motion into linear motion to execute movement. In such an embodiment of the present invention, actuator 101 may comprise gears, rails, pulleys, chains, worms from worm-gear assemblies, and other devices to tilt, rotate, and generally operate sunshade positioning device 100.

For example, and without limiting the scope of the present invention, a mechanical actuator in accordance with the present invention comprises a worm-gear assembly coupled to a rolled-up belt or pulley system that is mechanically coupled to either receiving member 102 or a bottom portion of sunshade 105's shaft 104. Although FIG. 1(*b*) shows a basic illustration of how actuator 101 is mechanically coupled to sunshade 105, a more detailed discussion of such an exemplary embodiment is discussed other figures, below.

In one exemplary embodiment, sunshade positioning device 100 is retrofitted to a sunshade at the bottom portion of the sunshade's shaft and in contact with a surface to ensure that a maximum range of motion for the sunshade is enabled when actuating sunshade positioning device 100. By placing sunshade positioning device 100 at the bottom portion of shaft 104, or adjacent to base 103, the shaded area that can be generated by a sunshade is maximized and the greatest coverage from the sun is achieved, particularly when the sun is hitting a location at an angle other than approximately 90° or directly above. This may happen, for example, at times earlier in the morning or in the afternoon when the sun hits at a smaller angle with respect to the ground. However, sunshade positioning device 100 may be coupled to any other portion of a shaft or support member of a sunshade without deviating from the scope of the present invention.

As shown in FIG. 1(*a*), sunshade positioning device 100 is coupled to the bottom of shaft 104 of sunshade 105 via receiving member (or shaft receiving member or sunshade receiving member) 102 and affixed or installed on a surface via base 103. Thus, sunshade positioning device 100 may be secured to a surface, such as a cement surface in a backyard, by coupling base 103 securely to the ground in a manner so that base 103 can pivot sunshade positioning device 100 a full range of 360°. By localizing sunshade positioning device 100 at the bottom portion of shaft 104 of sunshade 105, sunshade positioning device 100 may be actuated to position sunshade 105 in any angle, creating a larger shaded area as the sunlight changes direction. For example, a shaded area at a particular time of the day may be minimal, such as shaded area 106 shown in FIG. 1(*a*). Upon actuating sunshade positioning device 100 at a desired angle, the sunlight will impact sunshade 105 in a manner so that shaded area 106 is maximized, as shown in FIG. 1(*b*).

As stated above, receiving member 102 securely holds shaft 104 of sunshade 105. In one embodiment, receiving member 102 is permanently attached to shaft 104. In another embodiment, receiving member 102 forms a part of shaft 104, and thus shaft 104 replaces any sunshade shaft which may be coupled to rib assembly 107 and canopy 108. Although rib assembly 107 is the chosen assembly for the present figure, any assembly which provides reinforcement or support for a canopy, for instance canopy 108, may be utilized without deviating from the scope of the present invention.

In an exemplary embodiment, receiving member 102 may be removably coupled to shaft 104 and is configured to receive any umbrella or sunshade, such as sunshade 105. More specifically, sunshade receiving member 102 is configured to receive a sunshade's shaft, or support member that holds up sunshade's rib assembly and canopy (e.g. sunshade 105's rib assembly 107 and canopy 108). Thus, receiving member 102 allows for a wide range of sizes of umbrellas or sunshades to be retrofitted with sunshade positioning device 100.

As shown in FIG. 1(*a*), receiving member 102 is coupled to sunshade 105's support member or shaft 104. As stated above, receiving member 102 can be constructed of any durable material that will weather being installed outdoors, such as durable metals and plastics that do not rust in the rain and can withstand heat from summer days.

Receiving member 102 is typically constructed so that it has a tubular or cylindrical shape, with a diameter large enough to receive most types of sunshade support member or shaft sizes available in the marketplace. For example, and without limiting the scope of the present invention, in an exemplary embodiment, receiving member 102 is approximately 2" in diameter, which provides enough room for any size shaft of a typical outdoor sunshade. In such embodiment, a tightening mechanism can be utilized to secure sunshade 105 properly to receiving member 102, and thus sunshade 105 can be properly secured to sunshade positioning device 100.

Alternatively, receiving member 102 can comprise of any other shape, without deviating from the scope of the present invention. For example, in another embodiment, receiving member 102 can comprise a cubical or rectangular body that includes screws to tighten and hold an umbrella or sunshade's shaft such as shaft 104. In yet another embodiment, receiving member 102 can comprise a clamp mechanism that is adjustable so that multiple size shafts or sunshade support members can be coupled to receiving member 102, thus allowing multiple sunshade sizes to be retrofitted with sunshade positioning device 100.

Base 103 may similarly be constructed of a variety of materials without deviating from the scope of the present invention. In an exemplary embodiment, base 103 is made of metal and is durable enough to support the weight of sunshade positioning device 100 in addition to shaft 104 and sunshade 105. In another embodiment, base 103 is made of a durable plastic capable of weathering the outdoors and withstanding cold and hot climates.

Base 103 can comprise many body shapes and sizes. For example, and without deviating or limiting the scope of the present invention, base 103 may comprise a small base adapted to receive an actuator, for example, actuator 101. In one embodiment, as shown in FIG. 1(*a*) and (b), actuator 101 of sunshade positioning device 100 rests on top of base 103, and is coupled in a manner so that actuator 101 and thus the entire device 100 can rotate about its axis. Base 103 may be directly or indirectly coupled to actuator 101, with base 103 and actuator 101 in direct contact, or linked through another component, for instance a supporting body or the like. It will be understood that although base 103 may not rotate in many embodiments, discussion of the rotating capability of sunshade positioning device 100 is not undermined by base 103 being a stationary component, as the rotation may be relative to base 103, the ground, or the surface that base 103 is secured to. Additionally, in such embodiments wherein sunshade positioning device 100 is comprised of few components, base 103 may have a rotatable protruding member that extends below base 103 into the ground and enables rotation of sunshade positioning device and thereby the umbrella.

Nevertheless, other embodiments can be implemented without deviating from the scope of the present invention. For example, in another embodiment, base 103 comprises a base that is not affixed to a surface but which can be relocated from one place to another; such embodiment could comprise a plastic base that may use wheels. However, in an exemplary embodiment, base 103 comprises a small circularly shaped ring adapted to receive a cylindrically shaped member for enabling a rotation about the axis of sunshade positioning device 100.

Base 103 can be coupled directly to actuator 101 of sunshade positioning device 100, or to a supporting body or housing of sunshade positioning device 100 that either houses, connects, or is otherwise coupled to actuator 101 and receiving member 102. For example, and without limiting or deviating from the scope of the present invention, in one embodiment, base 103 is directly coupled to an actuator such as actuator 101, wherein sunshade positioning device 100 comprises only an actuator, a receiving member coupled to the actuator, and a base coupled to the bottom of the actuator for allowing rotational movement.

In an exemplary embodiment, sunshade positioning device 100 comprises a supporting body 110 to which each of the components of sunshade positioning device 100 are coupled to and held together. In such an embodiment, which is shown in both FIG. 1(*a*) and FIG. 1(*b*), actuator 101 is coupled to supporting body 110, and supporting body 110 supports receiving member 102 and rests on top of base 103. Although a better illustration and description of this exemplary embodiment is discussed below, supporting body 110 includes an extending member (see FIG. 3) which allows supporting body 110 to provide a rotational movement for positioning or rotating device 100 an entire 360°. Furthermore, supporting body 110 may be adapted to receive a portion of shaft 104 in a manner so that shaft 104 can be vertically oriented without getting in the way of any mechanical parts used to actuate movement of sunshade 105.

Moving on to the following figure, FIG. 1(*b*) shows an outdoor umbrella, or sunshade, retrofitted with the positioning device in accordance with the embodiment of the present invention shown in FIG. 1(*a*), wherein the sunshade positioning device has been activated to reposition the sunshade in order to maximize a shaded area without having to physically move or install the sunshade in a different location. In this exemplary embodiment, supporting body 110 is coupled to actuator 101 of sunshade positioning device 100, which is mechanically connected to a bottom portion of shaft 104 via an extending member 109.

Extending member 109 may comprise a number of mechanisms without deviating from the scope of the present invention. For example, extending member 109 can comprise an extending pole mechanism, a steel cable, any other strong cable, or a pulley mechanism with a spool that includes a belt, or any conceivable similar substitution or combination of such possibilities. Either mechanism implemented may be coupled to sunshade positioning device 100, and more specifically to actuator 101, in a manner so that when actuating the device, extending member 109 will extend and thus move the bottom portion of shaft 104 in an outwardly direction in order to alter or change the tilt angle of sunshade 105.

However, extending member 109 is not an entirely necessary component, and, in alternative embodiments, sunshade positioning device 100 could move or control the tilt angle of sunshade 105 without the need of implementing extending member 109. For example, and without liming or deviating from the scope of the present invention, actuator 104 can comprise a small electric actuator that is directly coupled to receiving member 102 in a manner so that actuation of actuator 104 would cause a rotational movement and hence cause pivot joint 111 to rotate and thus alter or change the tilt angle of sunshade 105. In such embodiment, actuator 101 could comprise a small electric actuator that is directly coupled to pivot joint 111.

Figure 2:
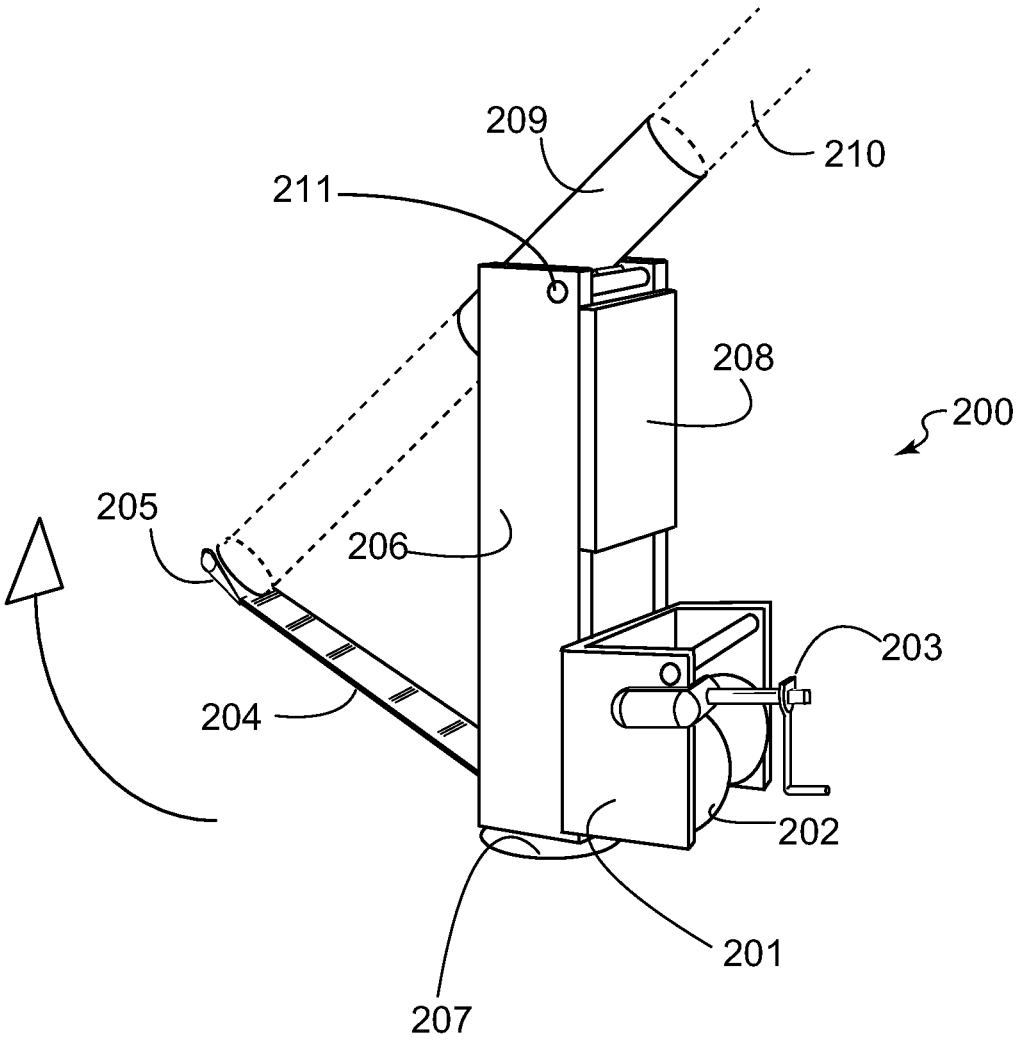
FIG. 2 is a front elevation schematic view of a sunshade positioning device in accordance with one embodiment of the present invention, comprising a belt system that extends or retracts in a manner so that a tilt angle of the sunshade can be controlled, wherein the device comprises a base adapted to pivot so that the device can rotate the sunshade 360°.

In an exemplary embodiment, a system comprising extending member 109, which incorporates the use of a belt-type pulley system, is implemented with sunshade positioning device 100, and is discussed in greater detail in FIG. 2.

Implementing sunshade positioning device 100 including a means for rotating and tilting sunshade 105, the device can be positioned to cover a vast array of angles and orientations. FIG. 1(*c*) shows sunshade 105, retrofitted with a positioning device in accordance with the embodiment of the present invention shown in FIG. 1(*a*) and FIG. 1(*b*), and illustrates how the sunshade positioning device can be configured to reposition the sunshade by rotating the sunshade about its vertical axis and by tilting or swinging the sunshade about its horizontal axis.

For example, and without limiting the scope of the present invention, sunshade positioning device 100 can have a range of motion along its x-axis, and can have a range of motion along its y-axis in a manner so that canopy 108 can touch the ground along circumference 150. This range of motion allows the top of the canopy to cover a semispherical area 155 which encompasses the area for providing shade. Hence, sunshade positioning device 100 can cover a significant area and provide shade throughout an entire day, regardless of the angle at which the sun's rays are impacting the immediate area about sunshade 105.

FIG. 2 is a front elevation schematic view of a sunshade positioning device in accordance with an exemplary embodiment of the present invention, comprising a belt pulley system that extends or retracts in a manner so that a tilt angle of the sunshade can be controlled, wherein the device comprises a base adapted to pivot so that the device can rotate the sunshade 360°.

More specifically, FIG. 2 shows the various components of sunshade positioning device 200, which is a sunshade positioning device in accordance with an exemplary embodiment of the present invention. The components include actuator 201, actuation mechanism 202, control lever 203, belt 204, shaft coupling member 205, a supporting body (or housing) 206, base 207, support or enclosure member 208, and shaft receiving member 209 for coupling to sunshade 210.

Actuator 201 is a mechanical actuator that includes an actuation mechanism 202 coupled to control lever 203, which is coupled to a spool that is mechanically adapted to receive a belt 204 for extending a bottom portion of an umbrella or sunshade 210, of which only a dotted line of its shaft is shown for purposes of focusing on sunshade positioning device 200. Furthermore, actuator 201 is coupled to body 206, which houses a portion of shaft 208 whenever sunshade 210 is brought to an upright position, such as an angle close to perpendicular with relation to the ground surface. Sunshade positioning device 200 is typically attached to a surface such as the ground via base 207, which is coupled to the bottom portion of body 206 in a manner so that body 206 can rotate 360°. Enclosure member 208 serves as an enclosure for body

206 so as to minimize exposure of moving parts to a user's feet around sunshade positioning device 200. Additionally, enclosure 208 serves as a support member to give sunshade positioning device 200 additional structural support and sturdiness.

Actuator 201 is a mechanical actuator and functions or is actuated by rotating control lever 203 in either direction. Control lever 203 is mechanically coupled to actuation mechanism 202 in a manner so that rotating control lever 203 causes actuation mechanism 202 to rotate and either extend or retract belt 204. Depending on the embodiment, this actuation may also be carried out with help from a worm in a worm-gear assembly. In such an embodiment, control lever 203 rotates the worm, which in turn rotates a gear coupled to a spool with an extending member such as belt 204 in order to extend or retract the extending member. The worm, however, is not a necessary component for extending or retracting an extending member such as belt 204. The spool exemplarily resembles a spool that would be known by a person of ordinary skill in the art, such as one which would capable of securing wound yarn. Thus, the spool has a central, exemplarily cylindrical component permitting the extending member, in this case belt 204, to tightly wrap around the component multiple times and remain secured within the confines of taller, outer components often resembling spacers. These outer components of the spool may also have coupling means for being secured or coupled to other components within actuator 201 like a gear, such as is the case in FIG. 3(*b*).

Because belt 204 is coupled to shaft coupling member 205, which in turn connects sunshade positioning device 200 to a bottom portion of the shaft of sunshade 210, extending or retracting belt 204 causes the position of the shaft of sunshade 210 to move closer or farther from a central axis. Thus, this movement controls the tilt of sunshade 210, so that providing shade from the sun can be achieved at nearly any angle. Shaft coupling member 205 may snap, screw, slide, magnetically attach, adhere, or otherwise become physically engaged with or to belt 204, shaft receiving member 209, or sunshade 210. Additionally, depending on the embodiment and the design of shaft receiving member 209, shaft coupling member 205 may be initially coupled to shaft receiving member 209, belt 204, or any other extending member that may be utilized in lieu of belt 204.

As mentioned above, the components of a device in accordance with the present invention can be constructed of any durable metals or non-metals such as plastics capable of weathering both hot and cold climates. Additionally, belt 204 can similarly be constructed or made from a variety of materials, including but not limited to any thermoplastics such as a nylon-based material, or any other material suitable for a belt or flexible member that may be rolled up, extended and retracted in a manner consistent with the present disclosure. For example, other materials can be used, such as wires, strings, or cables, without deviating or limiting the scope of the present invention.

Lastly, supporting body reinforcing member (or pivot joint) 211 reinforces the structure of supporting body 206 and thus aids in keeping the dimensionality of supporting body 206 constant. As a result, the functionality of components housed within or coupled to supporting body 206 is not hindered by supporting body 206. Supporting body reinforcing member 211 is secured in place across the upper portion of supporting body 206 through holes designed to receive supporting body reinforcing member 211.

As in the embodiment discussed above and illustrated in FIG. 1(*a*) and FIG. 1(*b*), sunshade positioning device 200 also has a base that is capable of providing a rotational movement to sunshade 210 by allowing sunshade positioning device 200 to rotate about its central axis. Base 207 is coupled to the bottom portion of supporting body 206, which is adapted with a protrusion (not shown) that extends into the ground or other non-elevated or elevated surface. Base 207 is adapted to receive the protruding member of supporting body 206 in a manner so that rotation of sunshade positioning device 200 is enabled. This feature of the present invention is discussed in more detail with regards to FIG. 3.

Figure 3A:
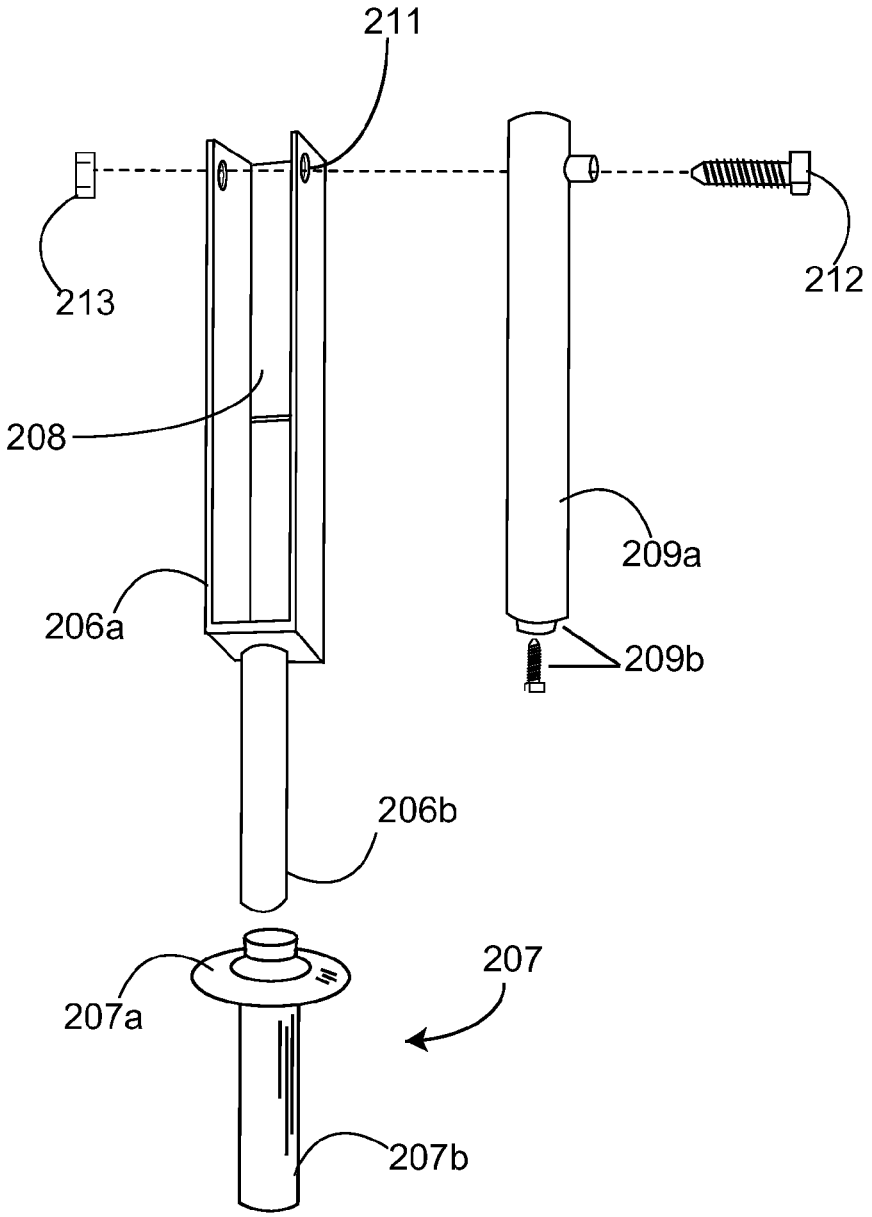
FIG. 3(*a*) is an exploded view of various components that make up the sunshade device shown in FIG. 2, in accordance with an exemplary embodiment of the present invention, wherein the sunshade device is installed on a surface.
Figure 3B:
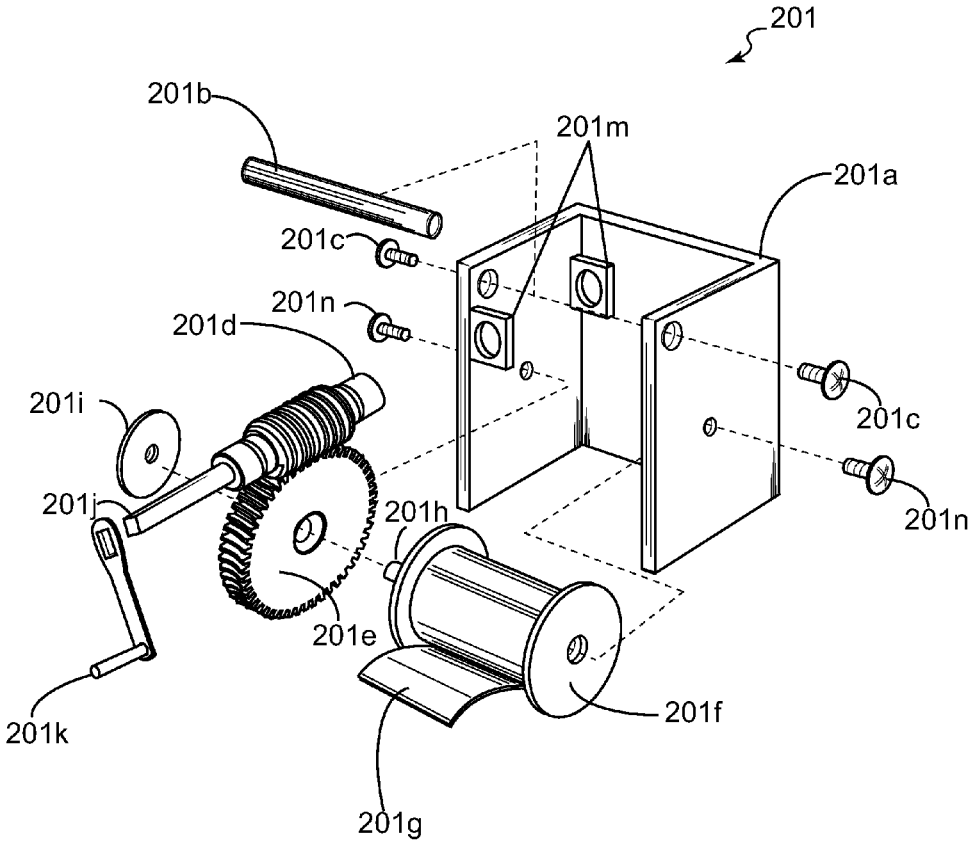

Turning to the next figure, FIG. 3(*a*) is an exploded view of the various components that make up the body of the sunshade device shown in FIG. 2, in accordance with an exemplary embodiment of the present invention, wherein the sunshade device is installed on a surface such as the ground or a cement portion of an outdoor area.

FIG. 3(*a*) shows the components that make the mechanism for a sunshade positioning device, in accordance with an exemplary embodiment, to house, support, and rotate the lower portion of an umbrella or sunshade's shaft. In this view of the drawings, only the housing is discussed, and the actuator is not shown. Instead, the actuator is shown in FIG. 3(*b*).

Starting with the base, base 207 is shown to comprise surface support 207*a* and tubular member 207*b*, which extends into the ground and is adapted to receive extending or protruding member 206*b* of supporting body (or housing) 206. In an alternative embodiment, protruding member 206*b* and tubular member 207 may be a single component existing as part of either base 207 or supporting body 206. Furthermore, supporting body 303 comprises supporting body reinforcing member 211 for receiving and coupling shaft receiving member 209*a*. Shaft receiving member 209 is adapted to receive a variety of sizes of sunshades or umbrellas and, when coupled to supporting body 206 via a regular screw and nut 212 and 213, allows for a pivot motion that alters or changes the tilt position of shaft receiving member 209*a*, and thereby controls the tilt angle of the sunshade that has been retrofitted with a sunshade positioning device. Naturally, this motion is actuated via an actuator that is coupled to supporting body 206 in any of the means discussed.

In the illustrated exemplary embodiment, shaft coupling member 209*b* is coupled to shaft receiving member 209*a* and is configured so that it may also be coupled to belt 204 or any other extending member. In some other embodiments, shaft coupling member 209*b* is not a component of shaft receiving member 209*a*, but is instead a component of the extending member, for example, belt 204 or a steel cable.

A user desiring to install a device in accordance with the present disclosure may do so in a number of ways. In an exemplary embodiment, base 207 is installed in the ground so that surface support 207*a* lays on the surface of the ground, and tubular member 207*b* lies below the surface. A variety of means can be used to secure base 207 to the ground such as adhesives, cement, or other reinforcing components. However, in an exemplary embodiment, base 207 is secured to the ground using screws that may be removed in case the user desires to uninstall the device from its location for whatever reason, such as moving to a different home. In such embodiment, the screws may be affixed to surface support 207*a* of supporting body 206.

Once base 207 is installed in the ground, supporting body 206 can be placed into tubular member 207*b* of base 207. Since tubular member 207*b* is adapted to receive protruding member 206*b* of supporting body 206, supporting body 206 may fit sturdily but loose enough to allow rotational movement. In this way, a user cannot only alter the tilt position of a sunshade by tilting or inducing tilt of the angle of shaft receiving member 209*a*, but may also rotate the direction of the tilting angle so that shade may be obtained regardless of the time of day or the location of the sun.

Shaft receiving member 209*a* contrasts with the non-exploded shaft receiving member 209 of FIG. 2. To illustrate, shaft receiving member 209 is not directly coupled to shaft coupling member 205 in FIG. 2 and is instead coupled to the shaft of sunshade 210. However, in FIG. 3, shaft receiving member 209*a* is directly coupled to shaft coupling member 205. Such embodiments are meant to serve as just two of the many possible embodiments that may afford a user a simple means of tilting an umbrella or sunshade.

Turning to the next figure, FIG. 3(*b*) shows the components that may actuate movement of a sunshade positioning device, in accordance with an exemplary embodiment. Actuator 201 comprises housing or actuator housing 201*a*, reinforcing member or actuator reinforcing member 201*b*, screws 201*c*, worm 201*d*, gear 201*e*, spool 201*f*, belt 201*g*, spool coupling member 201*h*, spacer 201*i*, worm coupling mechanism 201*j*, control lever 201*k*, worm housing 201*m*, and screws 201*n*.

Actuator housing 201*a* houses largely all of actuator 201 and serves as a source of coupling and reinforcement for many of the components of actuator 201. Actuator reinforcing member 201*b* reinforces the structure of actuator housing 201*a* and thus aids in keeping the dimensionality of actuator housing 201*a* constant so that the functionality of components housed within actuator housing 201*a* is not hindered by the housing 201*a*. Actuator reinforcing member 201*b* is secured in place across the upper portion of actuator housing 201*a* through holes designed to receive actuator reinforcing member 201*b*. Screws 201*c* serves as the primary securing means for actuator reinforcing member 201*b*.

Incorporated just under actuator reinforcing member 201*b* is the worm-gear assembly, which is principally comprised of parts such as worm 201*d* and gear 201*e*. A worm-gear assembly is useful for achieving higher torque and serving as a self-locking mechanism for securing sunshade 210 in place. As would be understood by a person of ordinary skill in the art, the worm gear assembly operates in a manner such that worm 201*d* is capable of turning gear 201*e*, but gear 201*e* is not capable of turning the worm 201*d*.

When worm 201*d* turns gear 201*e*, gear 201*e* then turns spool 201*f*, which extends or retracts belt 201*g* or any other extending member that comes into contact with a shaft coupling member. Gear 201*e* and spool 201*f* may be coupled by spool coupling member 201*h*, wherein spool coupling member 201*h* may penetrate the hole or holes in the center of gear 201*e* to incite this coupling. On the opposite side of gear 201*e*, spacer 201*i* completes the unit begun by the outermost spacer of spool 201*f*.

With the worm-gear assembly secured in place, coupling mechanism or worm coupling mechanism 201*j* is able to couple control lever 201*k* to worm 201*d*, allowing for a simple means of turning worm 201*d* and with it, gear 201*e* and spool 201*f*. Worm coupling mechanism 201*j* may be any coupling mechanism which allows the turning of control lever 201*k* to rotate worm 201*d*. On the reverse side, gear 201*e* is unable to move worm 201*d* as a result of the extreme friction that would be created by this motion, causing the worm gear assembly to naturally be a self-locking mechanism which, with reference to the present design, is rotatable only through interaction with control lever 201*k* or the like. Control lever 201*k* is not, however, an essential component for initiating the cascading, substantially synchronized motion of the components of actuator 201. However, control lever 201*k* does provide a simplified means for interacting with components of actuator 201 many times removed from its direct coupling. In other words, through rotation of control lever 201*k*, rotation of worm coupling mechanism 201*j* may be initiated, nearly instantaneously followed by rotation of worm 201*d*, gear 201*e*, and spool 201*f*.

Worm housing 201*m* serves as yet another securing means for the worm-gear assembly, specifically worm 201*d*. The ends of worm 201*d* approximately correspond to the location of the holes within worm housing 201*m*. Even once housed within worm housing 201*m*, worm 201*d* may be screwed in or the like, but only insofar as the ability of worm 201*d* to turn is not hindered.

Finally, screws 201*n* may enter through the final receiving holes present on actuator housing 201*a* and screw into spacer 201*i* and the outermost part of spool 201*f*.

It should be noted that variations to the described design in FIGS. 3(*a*) and 3(*b*) are possible and likely and should not be construed as a deviation from the scope of the present invention.

Figure 4:
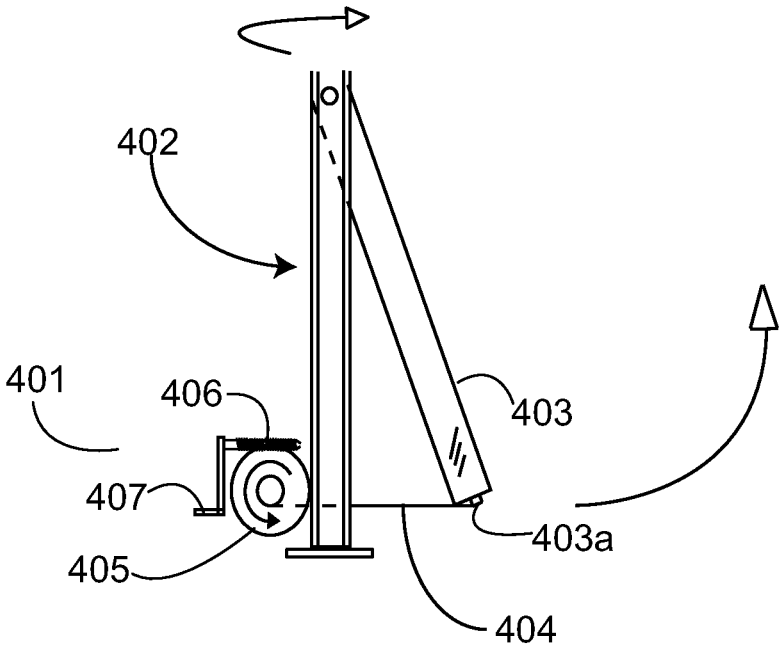
FIG. 4 is a cross-sectional plan view of the device, showing how a worm-gear assembly can be used with an actuator to provide the sunshade positioning device with the mechanical movement necessary to position and reposition an umbrella or sunshade retrofitted with a device, in accordance with an exemplary embodiment of the present invention.

FIG. 4 is a cross-sectional plan view of the device, showing how a worm-gear assembly can be used as an actuator to provide the sunshade positioning device with the mechanical movement necessary to position and reposition an umbrella or sunshade retrofitted with a device in accordance with an exemplary embodiment of the present invention.

Although as discussed above, many types of actuators can be used in accordance with the present invention, in an exemplary embodiment a mechanical actuator that includes a worm-gear assembly is used because this type of assembly offers an inexpensive manufacturing component that facilitates user installation in a simple to use configuration.

As shown, actuator 401 is coupled to supporting body (or housing) 402 in a manner so that the actuator is in mechanical contact with shaft receiving member 403. More specifically, actuator 401 comprises belt 404 which is attached to a bottom portion of shaft receiving member 403 via shaft coupling member 403*a*, which could comprise a simple screw.

Note that in this plan view of another exemplary embodiment of the present invention, shaft support member is longer and completely houses the bottom portion of a shaft of a sunshade, as oppose to requiring belt 404 to be attached or coupled to the shaft itself. This embodiment may be desirable since it offers a more convenient way to adapt or retrofit any sunshade or umbrella with a sunshade positioning device described herein.

Actuator 401 further comprises of gear system 405, which is coupled to worm 406, and control lever 407, for producing mechanical movement that rotates the gear within gear system 405. Gear system 405 a spool which houses or contains belt 404. As a user rotates control lever 407, which is coupled to worm 406, gear system 405 is forced to rotate and belt 404 either extends or is retracted depending on the direction the user rotates control lever 407. In the manner discussed above, this causes a sunshade that has been retrofitted with the present invention to tilt. Together, worm 406 and the gear within gear system 405 make up an actuation mechanism. In embodiments wherein a worm-gear system is not utilized, the actuation mechanism may comprise any other form of actuating means that would be known by a person of ordinary skill in the art.

Figure 5:
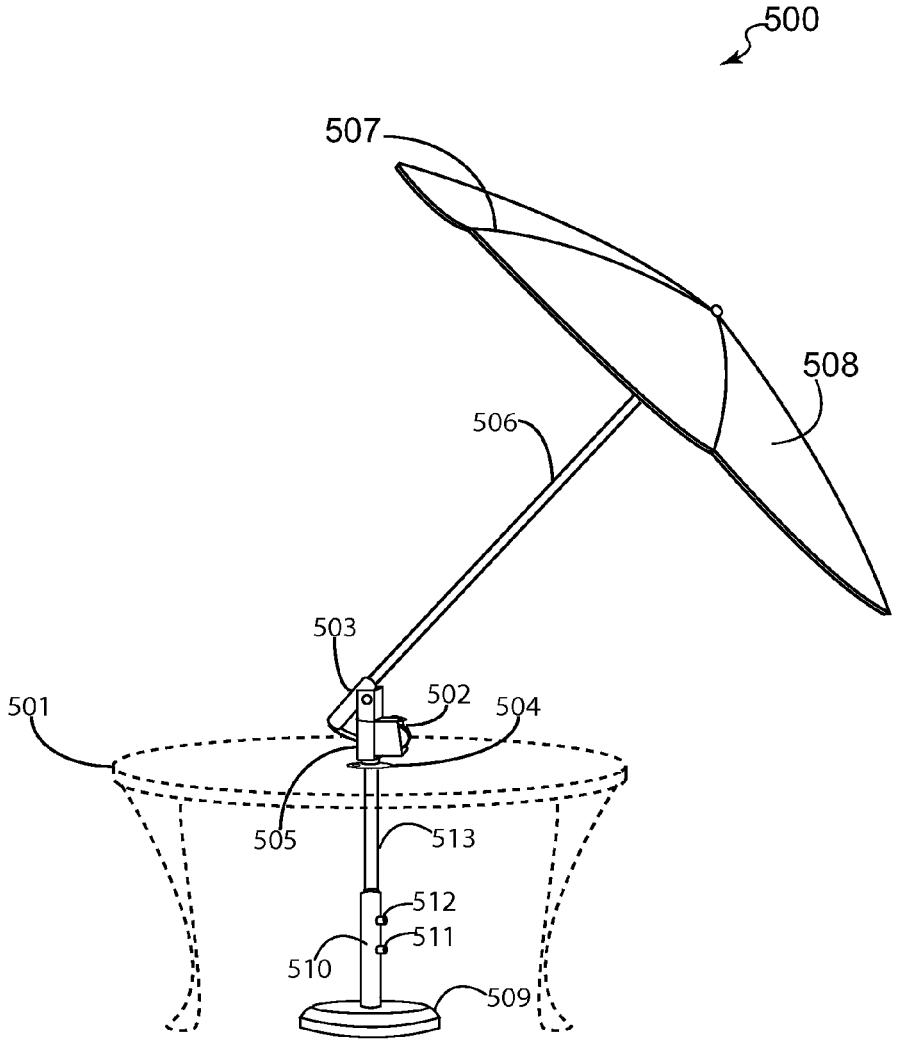
FIG. 5 depicts a sunshade positioning device installed on a table, in accordance with an exemplary embodiment of the present invention.

FIG. 5 depicts a sunshade positioning device installed on a table, in accordance with an exemplary embodiment of the present invention. In the present figure, sunshade positioning device 500 is installed on table 501 and comprises actuator 502, shaft receiving member 503, second base 504, second supporting body (or housing) 505, first base 509, first supporting body (or housing) 510, first tightening mechanism 511, second tightening mechanism 512, and elongated tubular member 513. Furthermore, shaft receiving member 503 presently houses shaft 506 of an umbrella, which is coupled to rib assembly 507 and canopy 508 of the same umbrella. As stated in the discussion of previous embodiments, the sunshade positioning device, and with respect to the illustrated figure, sunshade positioning device 500, need not comprise an extending member such as a pole or belt-pulley system to operate. In the exemplary case of sunshade positioning device 500 on table 501, indeed it may be preferable to provide a device for maximizing shade without utilizing an extending member so as to also maximize the space table-goers maintain while enjoying refuge from the sun. In any case, the largely unobstructive sunshade positioning device may still utilize an extending member without deviating from the scope of the present invention. Such an extending member may help provide additional support for the umbrella, especially shaft 506.

By contrast to preceding figures, the base coupled to the supporting body, which is itself coupled to the actuator, is not secured into the ground, but rather the table. In other words, second base 504, which is coupled to second supporting body 505 which is itself coupled to actuator 502, is secured into table 501, and not the ground. This exemplary embodiment thus illustrates how sunshade positioning device 500 may be successfully implemented to provide maximal shade over a table or other similar elevated surface.

However, securing second base 504 into table 501 rather than the ground or another solid, largely immovable surface or object, may present a problem depending on the strength and durability of table 501. Specifically, when the umbrella is tilted at an angle close to parallel with table 501, the high stress put on second base 504 may cause it to become uncoupled from table 501 if table 501 is ill-equipped for coupling. Thus, for such circumstances and for any other circumstance, implementation of a substitute primary support system may be utilized in addition to the support system provided by shaft receiving member 503, second base 504, second supporting body 505 and possibly an extending member such as a pole or belt-pulley system. It will be noted that second base 504 and second supporting body 505 may together be referred to as a base stand.

With respect to the illustrated exemplary embodiment, this substitute primary support system comprises first base 509, first supporting body 510, first tightening mechanism 511, and second tightening mechanism 512. It will be understood that the discussed support system may be manufactured as a single component or a plurality of components. Furthermore, discussed components residing below or above table 501 may be separate or singular components. For example, although first supporting body 510 and second supporting body 505 respectively reside below and above table 501 and are enumerated as separate components with a boundary formed by second base 504, they may in reality be a single manufactured component without deviating from the scope of the present invention.

First base 509 is exemplarily much larger than second base 504 and possesses sufficient weight to avoid being uprooted by an angled or oversized umbrella. In one embodiment, first base 509 and first supporting body 510 are a single component, with first supporting body 510 expanding vertically out of the center of first base 509. In the present figure, first supporting body 510 comprises first tightening mechanism 511 and second tightening mechanism 512, with first and second tightening mechanisms 511, 512 located at different heights along first supporting body 510 to better secure elongated tubular member 513 in place. As would be understood by a person of ordinary skill in the art, first and second tightening mechanisms 511, 512 may be coupled to screws or other securing means and, when tightened, press against elongated tubular member 513 to aid sunshade positioning device 500 in remaining firm and substantially parallel to first supporting body 510 despite great potential stress placed upon it by the umbrella.

In the illustrated exemplary embodiment, elongated tubular member 513 is a shaft-like component which links together first and second supporting bodies 510, 505. With reference to the exploded view displayed in FIG. 3, elongated tubular member 513 may exemplarily be an extended version of tubular member 301*b* emanating from below base 301 in FIG. 3, and from second base 504 in FIG. 5. Thus, elongated tubular member 513 may link the below-table components with the above-table components and provide an additional degree of resilience against undue stress created by an angled or weighty umbrella.

Figure 6:
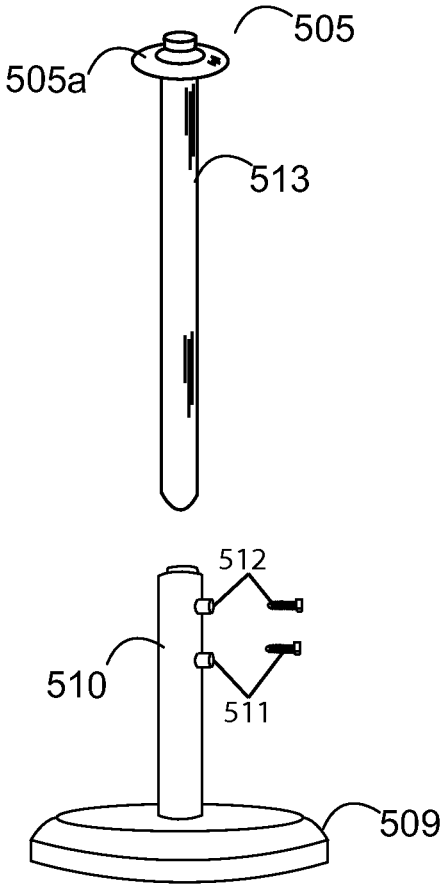
FIG. 6 is an exploded view of many of the components that make up the lower half of the sunshade device shown in FIG. 5, in accordance with an exemplary embodiment of the present invention, wherein the sunshade device is installed on a table.

FIG. 6 is an exploded view of many of the components that make up the lower half of the sunshade device shown in FIG. 5, in accordance with an exemplary embodiment of the present invention, wherein the sunshade device is installed on an elevated surface, for instance a table. Exploded components shown in FIG. 6 illustrate changes from the exploded components shown in FIG. 3. Elements of FIG. 5 not appearing or discussed in FIG. 6 may have their discussion thusly drawn from the pertinent discussion in FIG. 3.

With respect to the present figure, base 207 comprises surface support 207*a* and elongated tubular member 207*c*. Naturally, elongated tubular member 207*c* is an elongated version of tubular member 207*b* from FIG. 3(*a*). While tubular member 207*b* exemplarily extends into the ground, elongated tubular member 207*c* exemplarily extends through first supporting body 510 and into first base 509, which provides increased resilience for the device.

Supporting body 510 comprises first and second tightening mechanisms 511, 512, with each of these components, in an exemplary embodiment, comprising a tightening means such as a screw, and a receiving means for the tightening means. As the tightening means of first and second tightening mechanisms 511, 512 is forced further into supporting body 510 while elongated tubular member 207*c* resides in the hollow opening of supporting body 510, the empty space between elongated tubular member 207*c* and supporting body 510 is decreased, tightening and reinforcing the entire device. This allows the device to better resist bending brought about by the shaft and, more broadly, the sunshade or umbrella.

Figure 7:
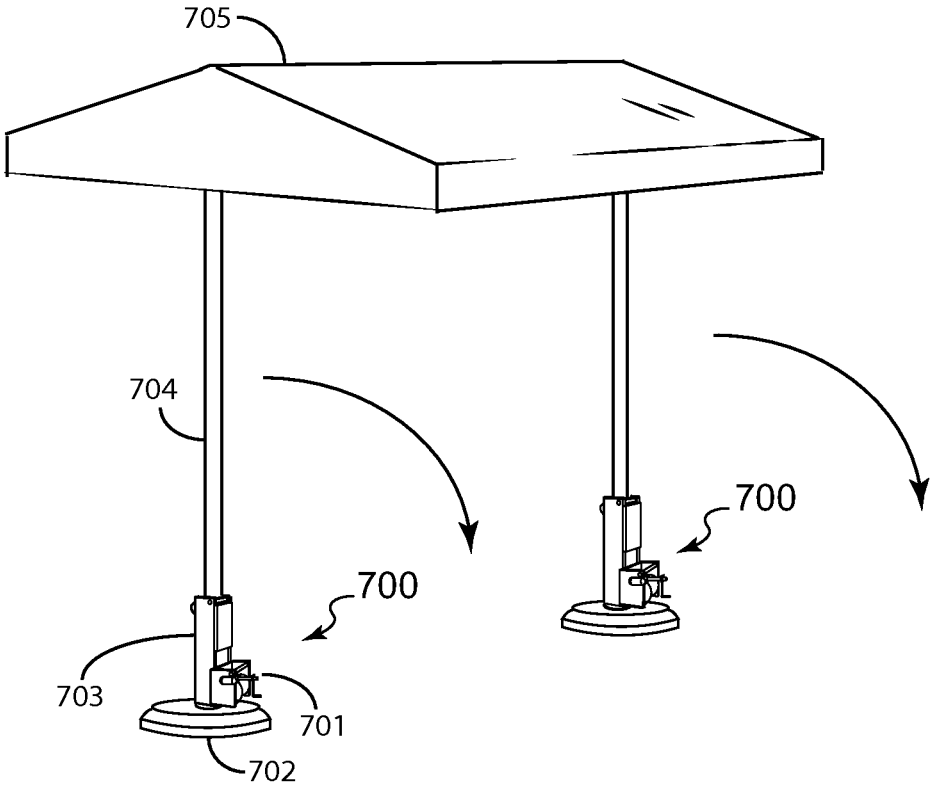
FIG. 7 comprises a set of sunshade positioning devices working in tandem to control a large, elongated sunshade, in accordance with an exemplary embodiment of the present invention.

FIG. 7 comprises a set of sunshade positioning devices working in tandem to control a large, elongated sunshade, in accordance with an exemplary embodiment of the present invention. It will be understood within the discussion of FIG. 7 pertaining to same, that unless specified otherwise, mention of a sunshade positioning device or components thereof will refer to both sunshade positioning devices and the components thereof. Sunshade positioning device 700 comprises actuator 701, base unit 702, supporting body (or housing) 703, and the shaft receiving member (not visible), with the shaft receiving member coupled to shaft 704, wherein shaft 704 is coupled to canopy 705.

Actuator 701 may be an actuator similar to those disclosed in previous embodiments, for instance a mechanical, electric, hydraulic, or pneumatic actuator. In an exemplary embodiment, actuator 701 is a mechanical actuator. In another exemplary embodiment, actuator 701 is an electric actuator with a motor. Base unit 702 serves as the base of sunshade positioning device 700 and may be either weighted to remain immobile, and or may be secured to the ground via screws, rods, tubular members, or the like. Base unit 702 is coupled to supporting body 703, which may house and or support the shaft receiving member as in the present figure. Extending from the shaft receiving member is shaft 704, which is coupled to canopy 705 either directly or via a rib assembly.

Because two sunshade positioning devices 700 are used together to move a single canopy 705, in an exemplary embodiment, the sunshade positioning devices 700 move in tandem so that, for example, when the left-installed sunshade positioning device 700 is tilted left and forward, so too is the right-installed sunshade positioning device 700. This may be accomplished through a number of means, of which a few will be enumerated. It will be understood that this enumeration is not exhaustive, merely illustrative. First, each of sunshade positioning devices 700 may be adjusted by a different person, so that the two individuals may adjust sunshade positioning devices 700 in tandem. Second, a single person may be able to adjust each of sunshade positioning devices 700 in increments so that canopy 705 is never becomes askew or disfigured. Third, in an exemplary embodiment, actuator 701 may be an electric actuator coupled to a motor and configured to respond to a movement command from an external device.

The illustrated canopy-sunshade positioning devices configuration may be desirable for larger-than-normal or awkwardly dimensioned tables or surfaces which are not adequately shaded by traditional umbrellas. Additionally, the present configuration allows for such tables or surfaces to be shaded at any time of day as a result of the immense range of motion of the discussed sunshade positioning devices 700.

To clarify, shaft 704 may be coupled either directly or indirectly to canopy 705. For instance, shaft 704 and canopy 705 may be coupled via a rib assembly or the like, or may be directly coupled without assistance from a rib assembly.

An apparatus for controlling tilt and pivot movement of an umbrella or sunshade has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

DESCRIPTION OF THE REFERENCE SYMBOLS

100: Sunshade positioning device
101: Actuator
102: Sunshade receiving member
103: Device base (base)
104: Shaft
105: Sunshade
106: Shaded area
107: Rib assembly
108: Canopy
109: Extending member
110: Supporting body
111: Pivot joint
150: Circumference
155: Semispherical area
200: Sunshade positioning device
201: Actuator
201*a*: Actuator housing
201*b*: Actuator reinforcing member
201*c*: Screws
201*d*: Worm
201*e*: Gear
201*f*: Spool
201*g*: Belt
201*h*: Spool coupling member
201*i*: Spacer
201*j*: Worm coupling mechanism
201*k*: Control lever
201*m*: Worm housing
201*n*: Screws
202: Actuation mechanism
203: Control lever
204: Belt
205: Shaft coupling member
206: Supporting body
206*a*: Supporting member
206*b*: Protruding member
207: Base
207*a*: Surface support
207*b*: Tubular member
208: Enclosure member
209: Shaft receiving member
209*a*: Shaft receiving member
209*b*: Shaft coupling member
210: Sunshade
211: Supporting body reinforcing member
212: Screw
213: Nut
401: Actuator
402: Supporting body
403: Shaft receiving member
403*a*: Shaft coupling member
404: Belt
405: Gear system
406: Worm
407: Control lever
500: Sunshade positioning device
501: Table
502: Actuator
503: Shaft receiving member
504: Second base
505: Second supporting body
505*a*: Surface support
506: Shaft
507: Rib assembly
508: Canopy
509: First base
510: First supporting body
511: First tightening mechanism
512: Second tightening mechanism
513: Elongated tubular member
700: Sunshade positioning device
701: Actuator
702: Base unit
703: Supporting body
704: Shaft
705: Canopy

What is claimed is:

1. A device for positioning an umbrella, comprising:

a shaft receiving member for receiving the shaft of an umbrella;

an actuator, coupled to said shaft receiving member, for enabling control of a tilt angle of the umbrella;

a base, coupled to the actuator, including a surface support for stabilizing the device on a surface and permitting rotation of the device about a central axis of the base;

an extending member, mechanically coupling the actuator to the shaft receiving member, wherein actuation of the actuator:

extends the extending member to move a bottom portion of the shaft receiving member away from the central axis of the base, causing the shaft of the umbrella to be angled with respect to the surface, and retracts the extending member to move the bottom portion of the shaft receiving member towards the central axis of the base, causing the shaft of the umbrella to be positioned perpendicular to the surface; and a supporting body atop the base that houses the actuator and the extending member, the supporting body including a protruding member that registers with a tubular receiving member extending from the bottom portion of the surface support, wherein the supporting body further includes a portion configured to receive the shaft receiving member whenever the umbrella is positioned perpendicular to the surface.

2. The device of claim 1, wherein the extending member is a belt.

3. The device of claim 1, wherein the extending member is a cable.

4. The device of claim 1, wherein the protruding member extends below the base and the surface to provide enhanced support for and enable the rotation of the device about the central axis of the base.

5. The device of claim 1, wherein the extending member is coupled to a shaft coupling member.

6. The device of claim 1, wherein the actuator comprises:

an actuation mechanism;

a control lever, for assisting the actuation mechanism in actuating movement of the umbrella; and a coupling mechanism, for coupling the actuation mechanism with the control lever.

7. The device of claim 6, wherein the actuation mechanism is a worm-gear assembly.

8. The device of claim 1, wherein the shaft receiving member is configured to receive a substantially cylindrical shaft.

9. A device for positioning an umbrella, comprising:

a shaft receiving member for receiving the shaft of an umbrella;

an actuator, coupled to said shaft receiving member, for enabling control of a tilt angle of the umbrella;

a base, coupled to the actuator, including a surface support for stabilizing the device on a surface and permitting device rotation about a central axis of the base;

a supporting body atop the base to support the shaft receiving member; and an extending member, mechanically coupling the actuator to the shaft receiving member, wherein actuation of the actuator:

extends the extending member to move the center of a bottom most portion of the shaft receiving member away from the central axis of the base, causing the shaft of the umbrella to be angled with respect to the surface, and retracts the extending member to move the center of the bottom most portion of the shaft receiving member towards the central axis of the base, causing the shaft of the umbrella to be positioned perpendicular to the surface; and wherein the actuator comprises:

a housing;

an actuation mechanism that includes a gear assembly;

a control lever, for assisting the actuation mechanism in actuating movement of an umbrella;

a coupling mechanism, for coupling the control lever to the gear assembly such that rotation of the control lever and the gear assembly are substantially synchronized;

a spool, for housing the extending member, the extending member being a belt; and a spool coupling member, for mechanically coupling the spool and the gear assembly, such that rotation of the gear assembly and the spool are substantially synchronized.

10. The device of claim 9, wherein the device further comprises a base stand below the base for supporting the base when the base is situated on an elevated surface.

11. The device of claim 10, wherein the base stand is coupled to the base by an elongated tubular member.

12. The device of claim 11, wherein the base stand comprises one or more tightening mechanisms for securing the elongated tubular member to the base stand.

13. The device of claim 9, wherein the gear assembly is a worm-gear assembly.

* * * * *